US005952276A

United States Patent [19]

de Ferran et al.

[11] Patent Number: 5,952,276

[45] Date of Patent: Sep. 14, 1999

[54] SOAP BAR COMPOSITION

[75] Inventors: Marcia de Ferran; Adolfo Gutmann; Sergio Roberto Leopoldino, all of Sao Paulo, Brazil

[73] Assignee: Lever Brothers Company, Division of Conopco, Inc., New York, N.Y.

[21] Appl. No.: 08/882,408

[22] Filed: Jun. 25, 1997

[30] Foreign Application Priority Data

Jun. 26, 1996 [BR] Brazil ..... 9602897

[51] Int. Cl.[6] ..... C11D 9/26; C11D 9/36

[52] U.S. Cl. ..... 510/141; 510/152; 510/153; 510/400; 510/440; 510/447; 510/481; 510/484

[58] Field of Search ..... 510/440, 130, 510/133, 141, 153, 447, 400, 152, 481, 484

[56] References Cited

U.S. PATENT DOCUMENTS

| | | | |
|---|---|---|---|
| 5,154,849 | 10/1992 | Visscher et al. | 510/150 |
| 5,264,144 | 11/1993 | Moroney et al. | 510/151 |
| 5,264,145 | 11/1993 | French et al. | 510/151 |
| 5,340,492 | 8/1994 | Kacher et al. | 510/146 |
| 5,425,892 | 6/1995 | Taneri et al. | 510/146 |
| 5,441,671 | 8/1995 | Cheney et al. | 510/156 |
| 5,501,812 | 3/1996 | Vermeer et al. | 510/153 |
| 5,703,026 | 12/1997 | Setser et al. | 510/152 |
| 5,786,312 | 7/1998 | Post et al. | 510/152 |

FOREIGN PATENT DOCUMENTS

| | | |
|---|---|---|
| 1060696 | 3/1989 | Japan . |
| 1294797 | 11/1989 | Japan . |
| 4370199 | 12/1992 | Japan . |
| 2058822 | 4/1981 | United Kingdom . |
| 2143250 | 2/1985 | United Kingdom . |
| 92/08444 | 5/1992 | WIPO . |
| 94/17172 | 8/1994 | WIPO . |
| 95/26710 | 10/1995 | WIPO . |

*Primary Examiner*—Lorna M. Douyon
*Attorney, Agent, or Firm*—Ronald A. Koatz

[57] ABSTRACT

A composition for a soap bar comprises:

(i) from about 0.5% to about 5%, by weight, of silicone;

(ii) from about 0.5% to about 5%, by weight, of a first emollient selected from polyols, selected from glycerin, sorbitol, or mixtures thereof;

(iii) up to about 5%, by weight, of a second emollient selected from vegetable, animal or mineral oils, or free fatty acids, or mixtures thereof.

4 Claims, No Drawings

SOAP BAR COMPOSITION

The present invention refers to a novel soap composition, particularly to a toilet soap bar for cleansing body skin, which has an improved mildness.

A general problem in the formulation of soap bars has been that of finding a balance between providing structure whilst both maintaining lathering properties and imparting beneficial mildness to the skin, at a practical overall cost.

The conventional soap making process is well documented in the literature. Patent application WO 920844 discloses a skin cleansing bar, which may be soap based and contains 0.5–20% of a silicone gum/silicone fluid. Polyalkyl siloxanes are preferred. This composition improves skin conditioning and moisturisation, and reduces both irritation and dryness. Optional ingredients include fatty acid as plasticizer, glycerine as moisturizer and a whole range of vegetable oils as occlusive moisturisers.

Patent application EP 578,841 discloses a solid soap containing 0.5–7% of a water insoluble silicone

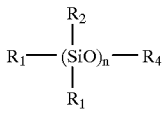

and optional ingredients such as glycerine. This product is intended to reduce cracking and flaking of the skin and to improve moisture retention.

Patent application GB 2,058,822 discloses a soap composition containing 0.01–6% of polydiorganosiloxane of molecular weight 2000 or higher and containing nitrogen and improves the feel of the skin after use.

Patent application GB 2,143,250 discloses a combination of vegetable oil and silicone oil which is used in a personal cleansing composition.

Patent application WO 9417172 (Unilever) discloses a syndet-based bar composition containing 0.1–9% of silicone and from 0–25% of soap and 0–35% of free fatty acid.

Patent application JP 01294797 discloses mixtures of silicone oils and optionally polyols (eg. glycerol) which are used in soaps based on counterions derived from weak bases.

Patent application JP 01060696 discloses mixtures of silicone oils and optionally polyols (eq. glycerol) which are used in transparent soaps.

SCOPE OF THE INVENTION

Due to the characteristics of surfactants present in conventional toilet soaps, although such soaps are extremely efficient cleansers of skin, this high efficiency may leave the skin unprotected immediately after the wash, thus provoking a stretched/dried out sensation.

In order to overcome this drawback, this present invention provides a new soap composition comprising fatty acid soap associated with mildness actives.

Laboratory tests have shown, surprisingly, than when silicones and other emollient agents are mixed together, toilet soaps begin to provide other benefits to the skin, over and above their cleansing qualities. These include the agreeable sensation of a lubricated hydrated and silky skin.

The results have been verified in internal evaluations done by sensory panellists.

Among the qualities of silicones which are applicable to the skin, the following may be highlighted: it is a hydrophobic substance, and thus water resistant, which remains after the rinsing process; it is a lubricant for the skin and hair. At the same time, it provides an improved tactile sensation and does not block the pores of skin.

These relevant features are optimized when the silicone is combined with other emollient agents. The principal mechanism for obtaining this state is by adsorption of these emollient agents into the silicone molecule.

Additionally, it was found that the soap composed in accordance with this invention gives a more creamy denser foam, when compared with current state of the art toilet soaps.

Thus, the present invention refers to a composition for soap, based on a conventional soap, with 65% to 85%, by weight, of total fatty acids, to which are added from 1% to 15%, by weight, of a combination of silicones and other emollients. To dry skin, this will give the sensation of soft, silky skin, to a greater extent than other soaps.

Different types of silicones, such as linear, cyclic, substituted silicones and their combinations may be used in the present composition. Silicone may comprise 0.5 to about 5%, by weight, of the compositions of the invention.

The emollients which are suitable for toilet soap, under this invention, may be selected from polyols, fatty acids, vegetable, mineral and animal oils, and other emollients which are similar or which may be adsorbed into the silicone chain.

Glycerin and sorbitol are preferred among the polyols.

Among the free fatty acids, babassu fatty acid and lauric acid are preferred.

From the vegetable oils, the sunflower oil, corn oil and almond oil among others may be used.

The compositions of the invention may comprise from about 0.5 to about 5% by weight of a first emollient which is a polyol as noted above and up to about 5.0% by weight of a second emollient selected from vegetable, animal or mineral oils, free fatty acids or mixtures thereof as noted above.

The composition of the toilet soap bar, prepared in accordance with this invention, may also include a certain percentage of an appropriate and desired perfume, added to the soap mix.

The composition of the toilet soap bar, prepared in accordance with this invention, may also include a certain percentage of an appropriate dye or colorant agent, added to the soap mix to impart the desired color to the soap bar.

The quantities of perfume and coloring agent to be added to the soap mix, prepared in accordance with this invention, are not critical, and should be such that they produce the desired coloring and aromatizing effect.

Below, a novel soap composition according to the present invention is described by way of an example of how it should be prepared.

This example is merely illustrative and in no way limits the scope of this invention.

EXAMPLE

In this example, a cold-rolled soap method is used to prepare a soap bar.

A previously prepared soap mix for making a toilet soap cake according to the present invention, composed of 65% to 85%, by weight, of salts of fatty acids, reckoned as total fatty acids, is placed in a crutching machine (Sigma, for example). The glycerine and/or polyols, silicone and other emollients are added in a proportion, by weight, of from 1% to 15%. The moisture contents of the mix is then set at between 8% to 20%, by weight.

Finally, the desired amount of an appropriate coloring agent (for example: Red Iragon PS paste and/of Orange Iragon II DC) is added, together with a desired amount of a soap compatible perfume, such as Gemini 699.

During the whole process of adding these ingredients, the composition is thoroughly mixed with a suitable stirrer. Once the mix is homogenous, the conventional stages of the process for obtaining soap or toilet soap in cakes are carried out, these being: rolling (with a Buehler/Mazzoni Roller), compacting and extruding (using a Bonot extruder), cutting of the extruded bar and stamping and wrapping the bar (using a Sigma or Acma Machine).

In this way, a cake of soap with a composition in accordance with this invention and having the characteristics defined hereinabove are obtained.

We claim:

1. A soap bar composition consisting of:

(i) from about 0.5% to about 5%, by weight, of silicone;

(ii) from about 0.5% to about 5%, by weight, of a first emollient which is a polyol selected from the group consisting of glycerin, sorbitol and mixtures thereof;

(iii) a second emollient selected form the group consisting of vegetable, animal or mineral oils, free fatty acids and mixtures thereof, wherein said second emollient is present in an amount up to about 5% by weight;

(iv) about 65% to 85% by weight fatty acid soap;

(v) between 8% to 20% by weight moisture; and (vi) effective amounts of coloring agent and perfume.

2. A soap bar composition as claimed in claim 1 wherein said silicone is selected from the group consisting of linear, cyclic, substituted silicones and mixtures thereof.

3. A soap bar composition as claimed in claim 1, wherein said free fatty acids are selected from the group consisting of babassu fatty acid, lauric acid and mixtures thereof.

4. A soap bar composition as claimed in claim 1, wherein the vegetable oil is selected from the group consisting of sunflower oil, corn oil, almond oil and mixtures thereof.

* * * * *